US010431137B2

(12) United States Patent
Zhao

(10) Patent No.: US 10,431,137 B2
(45) Date of Patent: Oct. 1, 2019

(54) DISPLAY DRIVING METHOD, DISPLAY PANEL AND MANUFACTURING METHOD THEREOF, AND DISPLAY APPARATUS

(71) Applicant: BOE TECHNOLOGY GROUP CO., LTD., Beijing (CN)

(72) Inventor: Hui Zhao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 224 days.

(21) Appl. No.: 15/106,887

(22) PCT Filed: Oct. 30, 2015

(86) PCT No.: PCT/CN2015/093389

§ 371 (c)(1),
(2) Date: Jun. 21, 2016

(87) PCT Pub. No.: WO2017/000450

PCT Pub. Date: Jan. 5, 2017

(65) Prior Publication Data

US 2017/0132963 A1 May 11, 2017

(30) Foreign Application Priority Data

Jun. 30, 2015 (CN) ..... 2015 1 0375193

(51) Int. Cl.
*G09G 3/20* (2006.01)
*G09G 3/3283* (2016.01)
*G09G 3/36* (2006.01)

(52) U.S. Cl.
CPC ..... *G09G 3/2003* (2013.01); *G09G 3/3283* (2013.01); *G09G 3/3607* (2013.01);
(Continued)

(58) Field of Classification Search
CPC ... G09G 2320/0233; G09G 2320/0276; G09G 3/2003; G09G 3/3283; G09G 3/3607; G09G 3/3688
See application file for complete search history.

(56) References Cited

U.S. PATENT DOCUMENTS 5,555,001 A * 9/1996 Lee ..... G09G 3/3688 327/526
5,654,733 A * 8/1997 Chimura ..... G09G 3/3614 345/209

(Continued)

FOREIGN PATENT DOCUMENTS

CN 1499462 A 5/2004
CN 102034448 A 4/2011

(Continued)

OTHER PUBLICATIONS

Chinese Office Action in Chinese Application No. 201510375193.3, dated Feb. 28, 2017 with English translation.

(Continued)

*Primary Examiner* — Patrick N Edouard
*Assistant Examiner* — Peijie Shen
(74) *Attorney, Agent, or Firm* — Collard & Roe, P.C.

(57) ABSTRACT

A display driving method, a display panel and a manufacturing method thereof, and a display apparatus are provided. The display driving method comprises: driving a display area of a display panel by using at least two data driving circuits (101); driving a part of display area of the display panel by each of the data driving circuits (102); and splicing display areas driven by respective data driving circuits as an entire display area (103). In the display driving method, the display area of the display panel is driven for display by using a plurality of data driving circuits. In this way, the display area driven by each of the data driving circuits is relatively small, and then a difference value of a distance (Continued)

from the data driving circuit to respective columns of sub-pixels within the driven display area is relatively small, so that the resulted difference of luminance is weakened.

15 Claims, 3 Drawing Sheets

(52) U.S. Cl.
CPC ... *G09G 3/3688* (2013.01); *G09G 2300/0443* (2013.01); *G09G 2320/0223* (2013.01); *G09G 2320/0233* (2013.01); *G09G 2320/0276* (2013.01)

(56) References Cited

U.S. PATENT DOCUMENTS 6,697,037 B1 * 2/2004 Alt ..... G02F 1/1309 345/93
8,564,627 B2 10/2013 Suzuki et al.
8,624,887 B2 * 1/2014 Chang ..... G09G 3/3648 345/204
2002/0080106 A1 * 6/2002 Miwa ..... G09G 3/3685 345/87
2003/0156122 A1 * 8/2003 Donahue ..... G06K 15/12 345/611
2004/0085303 A1 * 5/2004 Yabuuchi ..... G09G 3/3611 345/204
2006/0284819 A1 * 12/2006 Lin ..... G09G 3/3614 345/100
2007/0018923 A1 * 1/2007 Yokota ..... G09G 3/3688 345/89
2007/0236423 A1 * 10/2007 Chiou ..... G09G 3/3283 345/76
2009/0002302 A1 * 1/2009 Koo ..... G09G 3/3614 345/89
2009/0195700 A1 * 8/2009 Yun ..... H04N 9/3129 348/723
2010/0134472 A1 * 6/2010 Chang ..... G09G 5/10 345/212
2011/0057914 A1 * 3/2011 Nam ..... G09G 3/3648 345/211
2011/0175892 A1 * 7/2011 Lee ..... G09G 3/3696 345/212
2011/0199345 A1 * 8/2011 Yoshino ..... G02F 1/136286 345/204
2012/0169788 A1 * 7/2012 Jang ..... G09G 3/3614 345/690
2014/0063023 A1 * 3/2014 Baek ..... G09G 1/00 345/501
2015/0146123 A1 5/2015 Jung
2015/0187321 A1 * 7/2015 Kim ..... G09G 3/3696 345/87
2015/0310824 A1 * 10/2015 Yang ..... G09G 5/006 345/213
2016/0118006 A1 * 4/2016 Park ..... G09G 3/3666 345/690
2016/0253969 A1 * 9/2016 Chen ..... G02F 1/133 345/214
2016/0275839 A1 * 9/2016 Chen ..... G09G 3/2003
2018/0047324 A1 * 2/2018 Tao ..... G09G 3/2003

FOREIGN PATENT DOCUMENTS

CN 102854648 A 1/2013
CN 102854679 A 1/2013
CN 103208250 A 7/2013

OTHER PUBLICATIONS

International Search Report of PCT/CN2015/093389 in Chinese, dated Apr. 7, 2016 with English translation.
Notice of Transmittal of the International Search Report of PCT/CN2015/093389 in Chinese, dated Apr. 7, 2016.
Written Opinion of the International Searching Authority of PCT/CN2015/093389 in Chinese, dated Apr. 7, 2016 with English translation.

* cited by examiner

DISPLAY DRIVING METHOD, DISPLAY PANEL AND MANUFACTURING METHOD THEREOF, AND DISPLAY APPARATUS

CROSS REFERENCE TO RELATED APPLICATIONS

This application is the National Stage of PCT/CN2015/093389 filed on Oct. 30, 2015, which claims priority under 35 U.S.C. § 119 of Chinese Application No. 201510375193.3 filed on Jun. 30, 2015, the disclosure of which is incorporated by reference.

TECHNICAL FIELD

The present disclosure relates to a display driving method, a display panel and manufacturing method thereof, and a display apparatus.

BACKGROUND

A general display panel comprises only one data driving circuit, which is located at a central position of an upper part of the display panel. In this way, a length from a data line of the data driving circuit to a pixel column located at an edge area is greater than a length from a data line of the data driving circuit to a pixel column located at a central area. However, a wire resistance of the data line per se is relatively large, which would cause that certain difference of luminance exists in the pixel column located at the edge area and the pixel column located at the central area.

As the size of the display panel is increasingly larger, a distance from the data driving circuit to pixel columns located at left and right sides becomes further and further, and the length of the data line of the data driving circuit connected to the pixel column located at the edge area becomes longer and longer. Correspondingly, the resulted differences of luminance among different areas also become larger and larger.

SUMMARY

There are provided in some embodiments of the present disclosure a display driving method, a display panel and a manufacturing method of the same, and a display apparatus, which are used to weaken display luminance difference among different areas.

According to a first aspect of the present disclosure, there is provided a display driving method, comprising: driving display area of a display panel by using at least two data driving circuits; driving a part of display area of the display panel by each of the data driving circuits; and splicing display areas driven by respective data driving circuits as an entire display area.

Further, display areas driven by two adjacent data driving circuits have an overlapped area; the driving a display area of a display panel by using at least two data driving circuits comprises:

making data voltage which is written into each sub-pixel within the overlapped area be a value between a data voltage written into the sub-pixel when a first data driving circuit of the two adjacent data driving circuits drives the sub-pixel separately and a data voltage written into the sub-pixel when a second data driving circuit of the two adjacent data driving circuits drives the sub-pixel separately, in each frame.

Further, the making data voltage of each sub-pixel which is written into the overlapped area be a value between a data voltage written into the sub-pixel when a first data driving circuit of the two adjacent data driving circuits drives the sub-pixel separately and a data voltage written into the sub-pixel when a second data driving circuit of the two adjacent data driving circuits drives the sub-pixel separately, in each frame, comprises:

making both the first data driving circuit and the second data driving circuit generate data voltages for driving the sub-pixel, and writing the data voltages into the sub-pixel, in each frame.

According to a second aspect of the present disclosure, there is provided a display panel, comprising: at least two data driving circuits, each of which is used to drive a part of display area; and display areas driven by respective data driving circuits are spliced as an entire display area.

Further, display areas driven by two adjacent data driving circuits have an overlapped area.

Further, each sub-pixel within the overlapped area is connected to two data lines, one of which is connected to a first data driving circuit of the two adjacent data driving circuits and the other of which is connected to a second data driving circuit of the two adjacent data driving circuits.

Further, the overlapped area comprises at least two pixel columns, each of which comprises n sub-pixel columns, and a color of each of the n sub-pixel columns is different from colors of other sub-pixel columns, wherein n is a type of colors of sub-pixels comprised in the display panel.

Further, the display panel is a liquid crystal display panel or an organic light-emitting display panel.

According to a third aspect, there is provided a manufacturing method of a display panel, comprising following steps:

disposing at least two data driving circuits on an array substrate and making each of the data driving circuits used for driving a part of display area; and splicing display areas driven by respective data driving circuits as an entire display area.

Further, the disposing at least two data driving circuits on an array substrate and making each of the data driving circuits used for driving a part of display area comprises: making display areas driven by two adjacent data driving circuits have an overlapped area.

Further, the manufacturing method of the display panel further comprises: manufacturing an array substrate, making each sub-pixel of the array substrate within a first area and a second area connected to one data line, and each sub-pixel within a transition area between the first area and the second area connected to two data lines.

The disposing at least two data driving circuits on an array substrate and making display areas driven by two adjacent data driving circuits have an overlapped area comprises:

disposing the at least two data driving circuits on the array substrate, wherein one data driving circuit is connected to a data line connected to respective sub-pixels within the first area and one of the two data lines connected to respective sub-pixels within the transition area, and the other data driving circuit is connected to a data line connected to respective sub-pixels within the second area and another of the two data lines connected to respective sub-pixels within the transition area.

According to a fourth aspect of the present disclosure, there is provided a display apparatus, comprising any one of the display panel described above.

Further, the display apparatus described above can further comprise one power supply which is connected to respective data driving circuits and produces a same GAMMA voltage outputted to the respective data driving circuits.

In the display driving method, the display panel and the manufacturing method of the same, and the display apparatus provided in the embodiments of the present disclosure, the display area of the display panel is driven for display by using a plurality of data driving circuits. In this way, the display area driven by each of the data driving circuits is relatively small, and then a difference value of a distance from the data driving circuit to respective columns of sub-pixels within the driven display area is relatively small, so that the resulted difference of luminance is weakened.

DETAILED DESCRIPTION

In order to make the purposes, technical solutions and advantages of the embodiments of the present disclosure more clear, technical solutions in the embodiments of the present disclosure will be described clearly and completely with reference to figures. Obviously, the embodiments described herein are just a part of the embodiments of the present disclosure instead of all of the embodiments. Based on the embodiments of the present disclosure, all of the other embodiments obtained by those ordinary skilled in the art without paying any inventive labor shall fall into the protection scope defined in the Claims.

Figure 1:
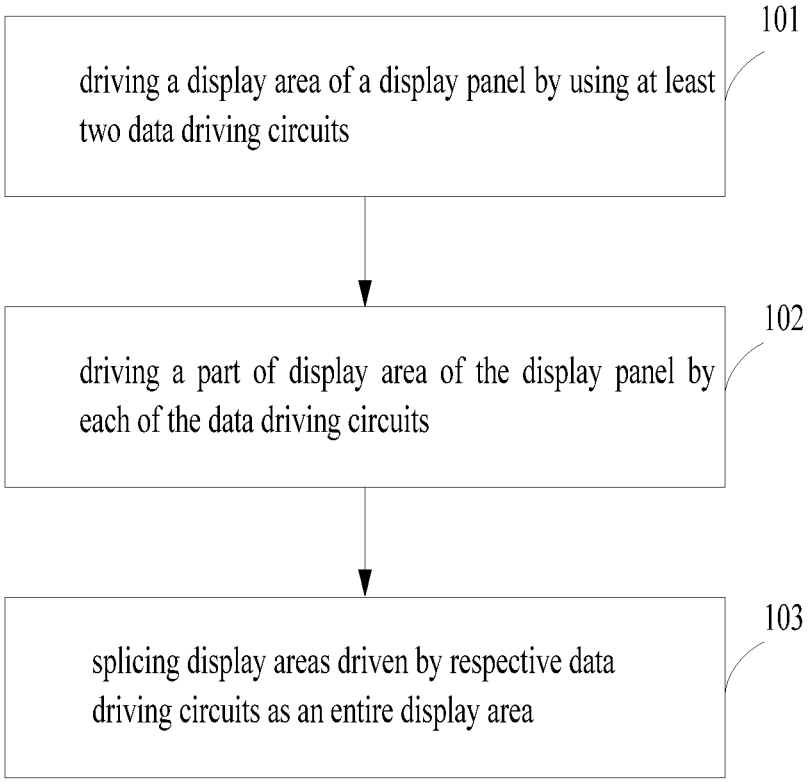
FIG. 1 is a schematic flow diagram of a display driving method provided in an embodiment of the present disclosure.

FIG. 1 shows a schematic flow diagram of a display driving method provided in an embodiment of the present disclosure. As shown in FIG. 1, the method comprises following steps: driving a display area of a display panel by using at least two data driving circuits (step 101); driving a part of display area of the display panel by each of the data driving circuits (step 102); and splicing display areas driven by respective data driving circuits as an entire display area (step 103).

In the display driving method provided in the embodiment of the present disclosure, the display area of the display panel is displayed and driven by using a plurality of data driving circuits. In this way, the display area driven by each of the data driving circuits is relatively small, and then a difference value of a distance from the data driving circuit to respective columns of sub-pixels within the driven display area is relatively small, so that the resulted difference of luminance is weakened.

Alternatively, in the display driving method described above, display areas driven by two adjacent data driving circuits can have an overlapped area. At this time, the driving the display panel by using at least two data driving circuits can comprise:

making data voltage written into each sub-pixel within the overlapped area be a value between a data voltage written into the sub-pixel when a first data driving circuit of the two adjacent data driving circuits drives the sub-pixel separately and a data voltage written into the sub-pixel when a second data driving circuit of the two adjacent data driving circuits drives the sub-pixel separately in each frame.

The benefit of doing so lies in enabling the luminance of the display panel more balanced. Specifically, in actual application, due to manufacturing process, it is unlikely that performance of respective data driving circuits is the same completely. Thus, it may result in that non-uniformity of luminance occurs at a jointed position of display areas driven by two different data driving circuits, thereby producing a luminance difference line. However, making the display areas driven by two data driving circuits have an overlapped area and making the data voltage written into each sub-pixel within the overlapped area be a certain value between the two data voltages when the two data driving circuits drive respectively the sub-pixel separately is helpful to weaken this luminance difference line.

For example, it can make within each frame the first data driving circuit and the second data driving circuit generate data voltages that drive the sub-pixel and write them into the sub-pixel. As such, the data voltage applied actually to the sub-pixel is approximately an average value of two data voltages generated by the first data driving circuit and the second data driving circuit with respect to the sub-pixel. This average value is capable of weakening the luminance difference line described above to the best advantage. In specific implementation, the overlapped area herein can comprise several (for example, two) columns of pixels, each of which comprises n columns of sub-pixels, where n refers to a type of colors of the sub-pixels comprised in the display panel.

In the specific implementation, the display driving method can be implemented with the aid of improvement of the structure of the display panel. A display panel for implementing the above method will be described with reference to FIG. 2.

Figure 2:
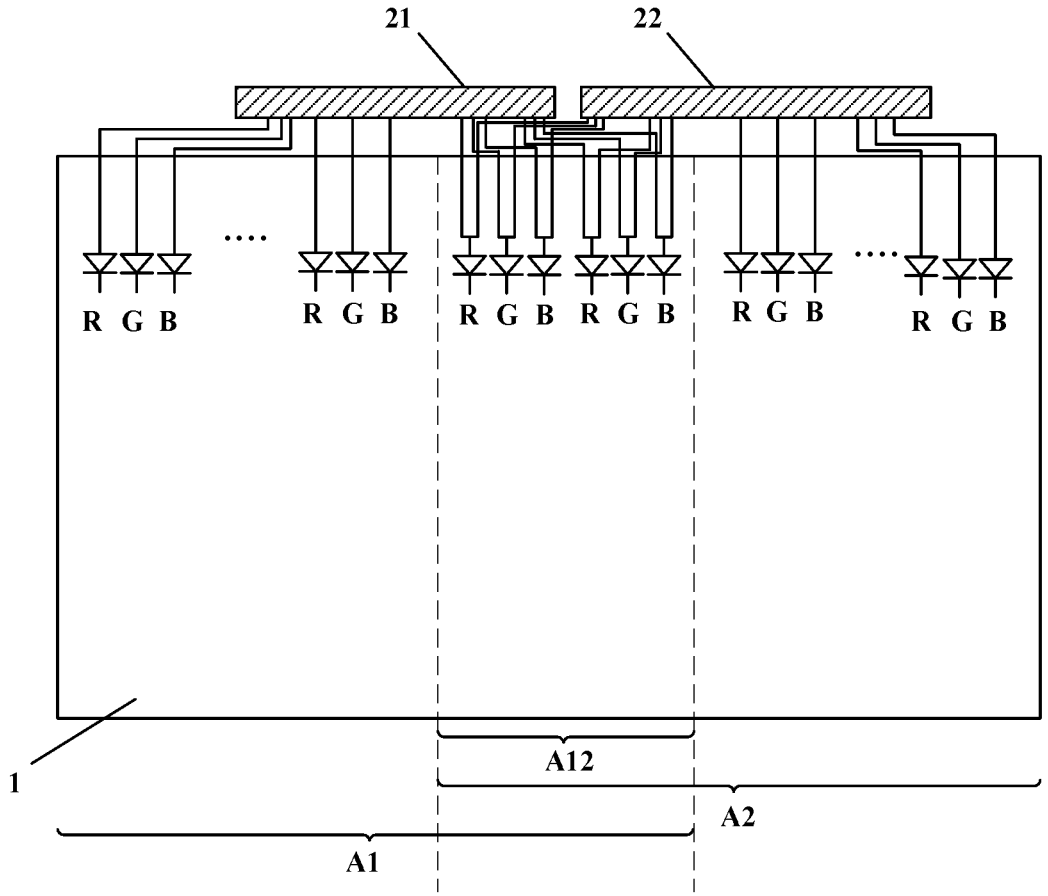
FIG. 2 is a schematic diagram of a structure of a display panel provided in an embodiment of the present disclosure.

FIG. 2 shows a schematic diagram of a display panel provided in an embodiment of the present disclosure. As shown in FIG. 2, the display panel comprises: a display substrate 1, a first data driving circuit 21 and a second data driving circuit 22. Herein, the first data driving circuit 21 is used to drive a display area A1 at the left side of the display panel, a second data driving circuit 22 is used to drive a display area A2 at the right side of the display panel, and the display area A1 driven by the first data driving circuit 21 and the display area A2 driven by the second data diving circuit 22 have an overlapped area A12.

In the embodiment of the present disclosure, two data driving circuits are used to drive display areas at the left side and right side of the display panel respectively. In this way, compared with a size of the entire display area, a size of a display area driven by each data driving circuit is reduced significantly, and thus a difference value among distances from the data driving circuit to respective columns of sub-pixels within the driven display area is relatively small, so that the luminance difference line resulted there from is weakened.

In the meantime, in the embodiments of the present disclosure, since pixels within the overlapped area are driven simultaneously by two data driving circuits, it is capable of weakening luminance difference within the overlapped area, so as to weaken the luminance difference line.

Figure 3:
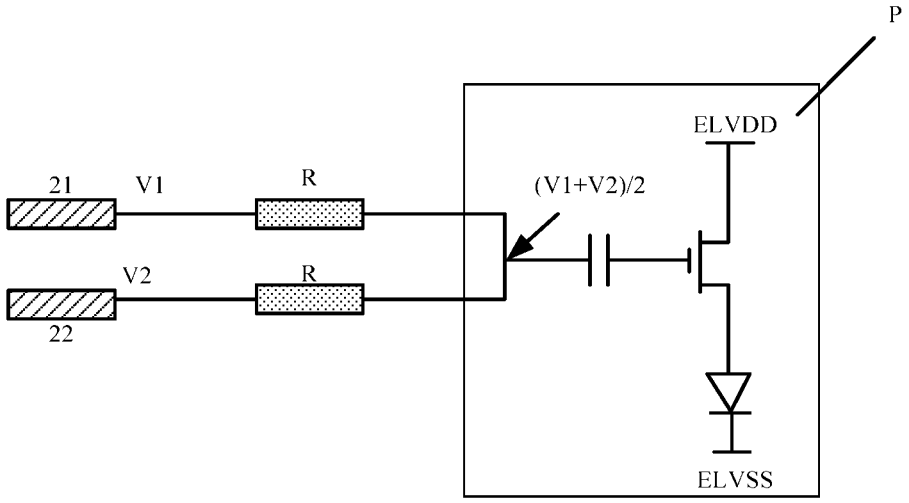
FIG. 3 is a schematic diagram of pixels located in an overlapped area being connected to a data driving circuit.

As an example, FIG. 3 shows a schematic diagram of pixels within the overlapped area being connected to the data driving circuit.

Exemplarily, as shown in FIG. 2 or 3, each pixel P within the overlapped area can be connected to two data lines, one of which is connected one data driving circuit 21 of the two data driving circuits, and the other of which is connected to another data driving circuit 22 of the same.

Since lengths of the two data lines in the overlapped area are substantially the same, wire resistance of the two data lines are also substantially the same (both are represented as R in FIG. 3). As shown in FIG. 3, assuming that a data voltage produced by the first data driving circuit 21 is V1 and a data voltage produced by the second data driving circuit 22 is V2, then a resistance from the first data driving circuit 21 to the second data driving circuit 22 is a sum of wire resistances of the two data lines, i.e., 2R, and an overall voltage drop is V1−V2. As such, a voltage drop from the first data driving circuit 21 to the pixel P is (V1−V2)/2, and then a voltage written into the pixel P is V1−(V1−V2)/2=(V1+V2)/2.

Of course, under the premise of being capable of making a data voltage written into each pixel within the overlapped area A12 be an average value of the data voltage produced by the first data driving circuit of the two data driving circuits with respect to the pixel and the data voltage produced by the second data driving circuit of the two data driving circuits with respect to the pixel, adopting specifically what kind of connecting manner does not affect the implementation of the present disclosure, and thus the corresponding technical solutions shall also fall into the protection scope of the present disclosure.

Referring to FIG. 2, since within the overlapped area, each column of sub-pixels is connected to two data lines, and one of which is connected to the first data driving circuit 21 on the left side, and the other of which is connected to the second data driving circuit 22 on the right side, the data line that one column of sub-pixels is connected to the first data driving circuit 21 on the left side and the data line that each sub-pixel column located on the left side of the column of sub-pixels is connected to the second data driving circuit 22 on the right side would have a cross. In order to avoid the two crossed data lines from being connected with each other, the two data lines can be formed at different layers, and insulating material is used to separate the two data lines.

In a specific implementation, as shown in FIG. 2, the overlapped area can comprise at least two columns of pixels, each of which comprises sub-pixel columns R, G, and B having three different colors. For example, if the above display substrate comprises 3480 columns of pixels, then the data driving circuit 21 can be used to drive the $1^{st}$ to the $1921^{st}$ columns of pixels, and the data driving circuit 22 can be used to drive the $1920^{th}$ to the $3480^{th}$ columns of pixels. At this time, the $1920^{th}$ column of pixels and the 1920 column of pixels are two pixel columns included within the overlapped area.

Of course, in the actual application, if the overlapped area comprises one column of pixels or more than two columns of pixels, it can also solve the basic problems proposed by the present disclosure, and thus the corresponding technical solutions shall also fall into the protection scope of the present disclosure. In addition, the above one column of pixels can also comprises a plurality of sub-pixel columns having other colors, for example, four pixel columns RGBW or four pixel columns CMYK, etc. Herein, examples will not be given one by one.

It needs to point out that the above embodiment is described by taking the number of the data driving circuits being 2 as an example. However, in the actual application, the number of the data driving circuit herein can also be multiple. At this time, display areas driven by any two adjacent data driving circuits can have an overlapped area.

In the specific implementation, the display panel herein can be a liquid crystal or an organic light-emitting display panel.

According to another aspect, there is provided a manufacturing method of a display panel, comprising following steps:

disposing at least two data driving circuits on an array substrate and making each of the data driving circuits used for driving a part of display area; and splicing display areas driven by respective data driving circuits as an entire display area.

In the display panel manufactured by the manufacturing method of the display panel provided in the embodiments of the present disclosure, the display area of the display panel is displayed and driven by using a plurality of data driving circuits. In this way, the display area driven by each of the data driving circuits is relatively small, and then a difference value of a distance from the data driving circuit to respective columns of sub-pixels within the driven display area is relatively small, so that luminance difference resulted there from is weakened.

Further, the disposing at least two data driving circuits on an array substrate and making each of the data driving circuits used for driving a part of display area comprises: making display areas driven by two adjacent data driving circuits have an overlapped area.

In this way, the sub-pixels within the overlapped area are driven simultaneously by two data driving circuits, which is capable of weakening the luminance difference within the overlapped area, so as to weaken the luminance difference line.

In the specific implementation, the manufacturing method of the display panel can further comprise following steps: manufacturing an array substrate, and making each sub-pixel of the array substrate within a first area and a second area connected to one data line and each sub-pixel within a transition area between the first area and the second area connected to two data lines.

The disposing at least two data driving circuits on an array substrate and making display areas driven by two adjacent data driving circuits have an overlapped area comprises:

disposing the at least two data driving circuits on the array substrate, wherein one data driving circuit is connected to a data line connected to respective sub-pixels within the first area and one of two data lines connected to respective sub-pixels within the transition area, and the other data driving circuit is connected to a data line connected to respective sub-pixels within the second area and another of the two data lines connected to respective sub-pixels within the transition area.

When the array substrate manufacturing method herein is used to manufacture the array substrate 1 as shown in FIG. 2, respective sub-pixels of the manufactured array substrate within the area A1 except for the area A12 and the area A2 except for an area A12 can be connected to one data line. That is, only one data line is disposed with respect to one column of sub-pixels, that is, one data line is disposed with respect to one column of sub-pixels within the area except for the area A12; respective sub-pixels within the area A12 are connected to two data lines, that is, two data lines are disposed with respect to one column of sub-pixels within the area A12.

Then, the data driving circuits 21 and 22 are arranged on the array substrate 1, the data driving circuit 21 is connected to the respective columns of sub-pixels within the area A1, and the data driving circuit 22 is connected to the respective columns of sub-pixels within the area A2. In this way, the respective columns of sub-pixels within the area A12 are connected to two data lines.

According to another aspect, there is further provided in the present disclosure a display apparatus, comprising the display panel provided in the above embodiments.

The display apparatus herein can be any product or elements having the display function such as an electronic paper, a mobile phone, a tablet computer, a TV set, a display, a notebook computer, a digital frame, and a navigator or the like.

In the specific implementation, the display panel herein can further comprise a power supply which is connected to respective data driving circuits and produces a same GAMMA voltage outputted to the respective data driving circuits.

The benefit of doing so lies in being capable of avoiding different power supply from producing GAMMA voltage difference, so as to further weaken the luminance difference line.

The above descriptions are just specific implementations of the present disclosure. However, the protection scope of the present disclosure is not limited thereto. Any alternation or replacement that can be easily conceived by those skilled in the art who are familiar with the technical filed within the technical scope of the present disclosure shall be covered within the protection scope of the present disclosure. Therefore, the protection scope of the present disclosure shall be subjected to the protection scope of the Claims.

The present application claims the priority of a Chinese patent application No. 201510375193.3 filed on Jun. 30, 2015. Herein, the content disclosed by the Chinese patent application is incorporated in full by reference as a part of the present disclosure.

What is claimed is:

1. A display driving method, comprising:

driving display area of a display panel by using at least two data driving circuits each of which is connected to a plurality of data lines, each data line of the plurality of data lines connected to at least one sub-pixel;

driving a part of display area of the display panel by each of the data driving circuits; wherein:

a first data driving circuit of the at least two data driving circuits is connected to data lines within a first area of the display area;

a second data driving circuit of the at least two data driving circuits is connected to data lines within a second area of the display area;

wherein the first area partially overlaps with the second area, the partially overlapped area comprises at least one sub-pixel connected to both the first data driving circuit and the second data driving circuit, and the sub-pixel arranged in the partially overlapped area of the first area and the second area is driven simultaneously by the first data driving circuit and the second data driving circuit, wherein at least one sub-pixel arranged in a portion of the first area not overlapping with the second area is only driven by the first data driving circuit and not driven by the second data driving circuit;

wherein at least one sub-pixel arranged in a portion of the second area not overlapping with the first area is only driven by the second data driving circuit and not driven by the first data driving circuit.

2. The display driving method according to claim 1, comprising:

making data voltage which is written into each sub-pixel within the partially overlapped area be a value between a first data voltage written into the sub-pixel when the first data driving circuit of the at least two data driving circuits drives the sub-pixel separately and a second data voltage written into the sub-pixel when the second data driving circuit of the at least two data driving circuits drives the sub-pixel separately, in each frame.

3. The display driving method according to claim 2, further comprising:

making both the first data driving circuit and the second data driving circuit generate data voltages for driving the sub-pixel, and writing the data voltages into the sub-pixel, in each frame.

4. A display panel, comprising: at least two data driving circuits, each of which is connected to a plurality of data lines and is configured to drive a part of display area, each data line of the plurality of data lines connected to at least one sub-pixel;

a first data driving circuit of the at least two data driving circuits is connected to data lines within a first area of the display area;

a second data driving circuit of the at least two data driving circuits is connected to data lines within a second area of the display area;

wherein the first area partially overlaps with the second area, the partially overlapped area comprises at least one sub-pixel connected to both the first data driving circuit and the second data driving circuit, and the sub-pixel arranged in the partially overlapped area of the first area and the second area is configured to be driven simultaneously by the first data driving circuit and the second data driving circuit, wherein at least one sub-pixel arranged in a portion of the first area not overlapping with the second area is configured to be only driven by the first data driving circuit and not driven by the second data driving circuit;

wherein at least one sub-pixel arranged in a portion of the second area not overlapping with the first area is configured to be only driven by the second data driving circuit and not driven by the first data driving circuit.

5. The display panel according to claim 4, wherein each sub-pixel within the partially overlapped area is connected to two data lines, one of which is connected to the first data driving circuit of the at least two data driving circuits and the other of which is connected to the second data driving circuit of the at least two data driving circuits.

6. The display panel according to claim 5, wherein the partially overlapped area comprises at least two pixel columns, each of which comprises n sub-pixel columns, and a color of each of the n sub-pixel columns is different from colors of other sub-pixel columns, where n is a type of colors of sub-pixels contained in the display panel.

7. The display panel according to claim 4, wherein the display panel is a liquid crystal display panel or an organic light-emitting display panel.

8. A display apparatus, comprising the display panel according to claim 4.

9. The display apparatus according to claim 8, further comprising a power supply which is connected to respective data driving circuits and produces a same GAMMA voltage outputted to the respective data driving circuits.

10. The display apparatus according to claim 8, wherein each sub-pixel within the partially overlapped area is connected to two data lines, one of which is connected to the first data driving circuit of the at least two data driving circuits and the other of which is connected to the second data driving circuit of the at least two data driving circuits.

11. The display apparatus according to claim 10, wherein the partially overlapped area comprises at least two pixel columns, each of which comprises n sub-pixel columns, and a color of each of the n sub-pixel columns is different from colors of other sub-pixel columns, where n is a type of colors of sub-pixels contained in the display panel.

12. The display apparatus according to claim 8, wherein the display panel is a liquid crystal display panel or an organic light-emitting display panel.

13. A manufacturing method of a display panel, comprising:

disposing on an array substrate at least two data driving circuits each of which is connected to a plurality of data lines and is configured to drive a part of display area, each data line of the plurality of data lines connected to at least one sub-pixel;

a first data driving circuit of the at least two data driving circuits is connected to data lines within a first area of the display area;

a second data driving circuit of the at least two data driving circuits is connected to data lines within a second area of the display area;

wherein the first area partially overlaps with the second area, the partially overlapped area comprises at least one sub-pixel connected to both the first data driving circuit and the second data driving circuit, and the sub-pixel arranged in the partially overlapped area of the first area and the second area is configured to be driven simultaneously by the first data driving circuit and the second data driving circuit, wherein at least one sub-pixel arranged in a portion of the first area not overlapping with the second area is configured to be only driven by the first data driving circuit and not driven by the second data driving circuit;

wherein at least one sub-pixel arranged in a portion of the second area not overlapping with the first area is configured to be only driven by the second data driving circuit and not driven by the first data driving circuit.

14. The manufacturing method according to claim 13, further comprising: manufacturing an array substrate, making each sub-pixel of the array substrate within the first area and the second area other than the partially overlapped area connected to one data line, and each sub-pixel within the partially overlapped area connected to two data lines.

15. The manufacturing method according to claim 14, further comprising:

disposing the at least two data driving circuits on the array substrate, wherein one data driving circuit is connected to a data line connected to respective sub-pixels within the first area other than the partially overlapped area and one of the two data lines connected to respective sub-pixels within the partially overlapped area, and the other data driving circuit is connected to a data line connected to respective sub-pixels within the second area other than the partially overlapped area and another of the two data lines connected to respective sub-pixels within the partially overlapped area.

* * * * *